United States Patent [19]

Gimber et al.

[11] Patent Number: 4,578,877

[45] Date of Patent: Apr. 1, 1986

[54] PROCESS FOR CONTROLLING FINES ENTRAINMENT WHILE DRYING SOLIDS

[75] Inventors: Gerald A. Gimber; Elliot M. Haschke, both of Lake Jackson, Tex.; Kenneth O. Groves, Midland, Mich.

[73] Assignee: The Dow Chemical Company, Midland, Mich.

[21] Appl. No.: 677,649

[22] Filed: Dec. 3, 1984

[51] Int. Cl.[4] ..... F26B 7/00; F27B 15/12

[52] U.S. Cl. ..... 34/12; 432/16

[58] Field of Search ..... 34/12; 432/16; 55/7, 55/8, 9, 10

[56] References Cited

U.S. PATENT DOCUMENTS

| | | | |
|---|---|---|---|
| 2,538,482 | 1/1951 | Studebaker | 34/12 X |
| 2,833,750 | 5/1958 | Vickers | 34/12 X |
| 4,254,560 | 3/1981 | Tanaka et al. | 34/12 |

*Primary Examiner*—John J. Camby

*Attorney, Agent, or Firm*—Glwynn R. Baker

[57] ABSTRACT

A process is disclosed for reducing the evolution of fine particles during the removal of a solvent from a mass of solid particles containing the fines or which solid particles are attritable to produce the fines in the prior treating steps and/or the solvent removal step. The process employs the addition of 1 to 20 percent by weight of water to the solid particles/solvent prior to or during the solvent removal operation.

9 Claims, 2 Drawing Figures

PROCESS FOR CONTROLLING FINES ENTRAINMENT WHILE DRYING SOLIDS

BACKGROUND OF THE INVENTION

Many processes can be found in the technical and patent literature describing procedures to reduce the carry over of fines in vapor streams produced during drying of a solid particles mass following treatment of the particles with a liquid. Most of such literature deals with means to prevent the production of fines and/or wash fines away for further treatment to recover them in a secondary fines recovery from a liquid. Other processes utilize cyclones, bag houses, electrostatic precipitation, as well as liquid quench of a gas stream carrying the fines.

Each of these techniques has some disadvantages besides requiring special and often high initial capital and/or operating expense, e.g. bag houses are labor and utilities intensive, cyclones are subject to mechanical erosion and are limited in particle size efficiency, as are electrostatic precipitators, while quench techniques usually require a high purity quench liquid and a solids from liquid separation step.

It would therefore be advantageous to have a technique whereby the fines associated with a mass of solid particles which have been treated with a liquid organic solvent, which solids may be attritable during or prior to a liquid removal step, can be maintained with the mass while subjecting the mass to a liquid removal operation.

BRIEF DESCRIPTION OF THE INVENTION

In accordance with the present invention a mass of solid particles, e.g. sand, which has associated with the mass a continuum of fines naturally or produced by attrition from the particles being treated, to remove a vaporizable organic liquid treating agent by evaporation is wet with from about 1 to about 20 and preferably about 2 to 10 and most preferably from about 2 to about 6 weight percent of water, based on the total weight of the particles, fines and vaporizable liquid, and subjected to the normal vaporizing unit operation. The addition of water to the total mass causes the fine particles to remain with the larger solid particles and not be carried off with the vapors.

Several explanations may be put forth for this unexpected phenomenum, however, we do not wish to be limited to any theoretical explanation. One plausible explanation when working with sand is that the water is attracted to the sand particles and the fines and the fines simply agglomerate and/or coat the larger particle water wet surface. Since the organic solvent usually boils below water, vaporization step does not heat the sand above the boiling point of the water. Even if the boiling point of the solvent is above that of water much of the water is associated with the sand in the form of bound, hydrate or free water, temperatures considerably greater than the water boiling point are required to release this water. Further so long as the water added does not slurry the particles, the particles flow as wet sand would, the water does not have to be removed from the sand since water is eventually added to the sand to stabilize the pile.

DETAILED DESCRIPTION OF THE INVENTION

Figure 1:
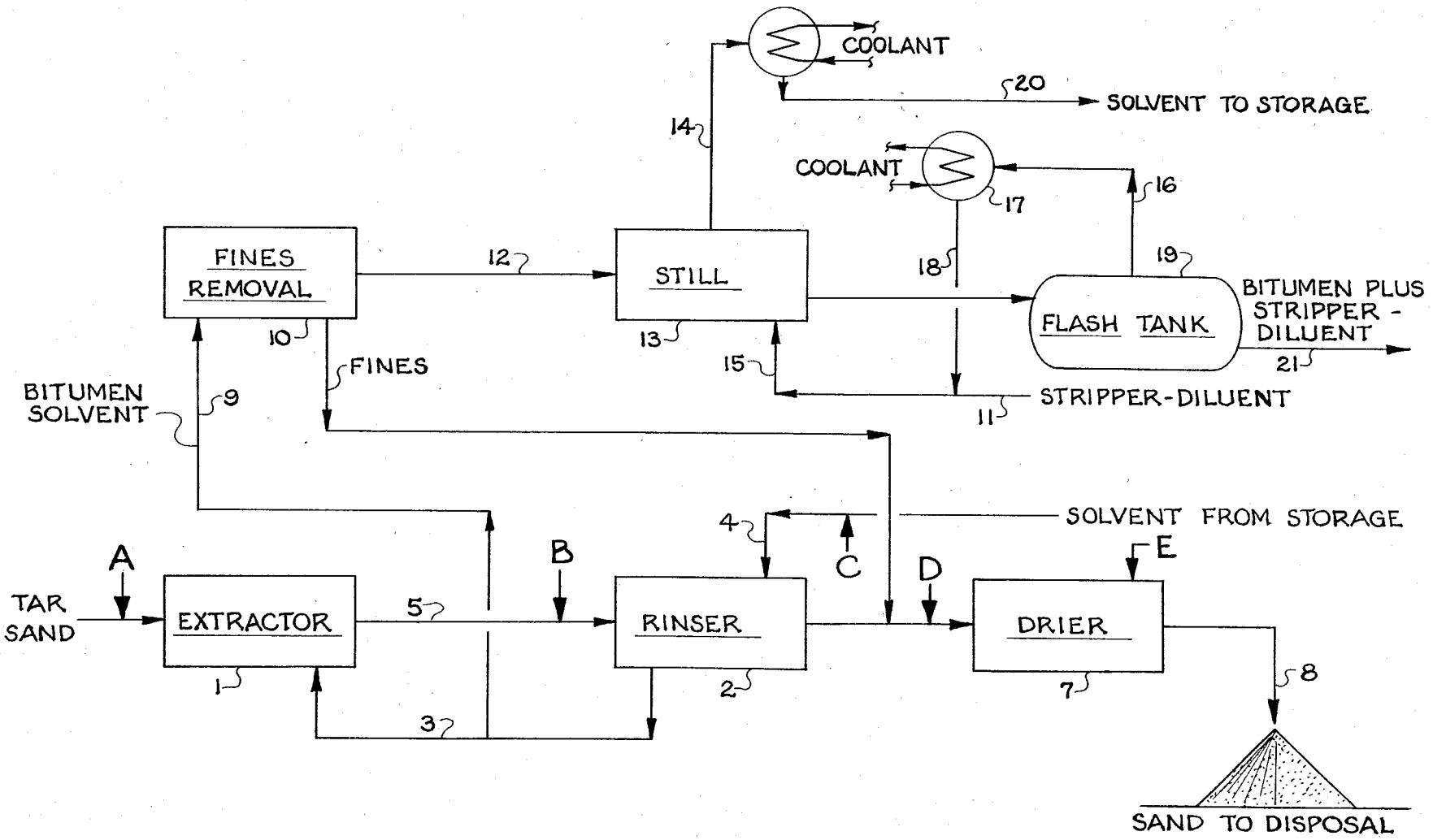
FIG. 1 represents in simplified form an overall flow diagram of the unit operations of the present invention.
Figure 2:
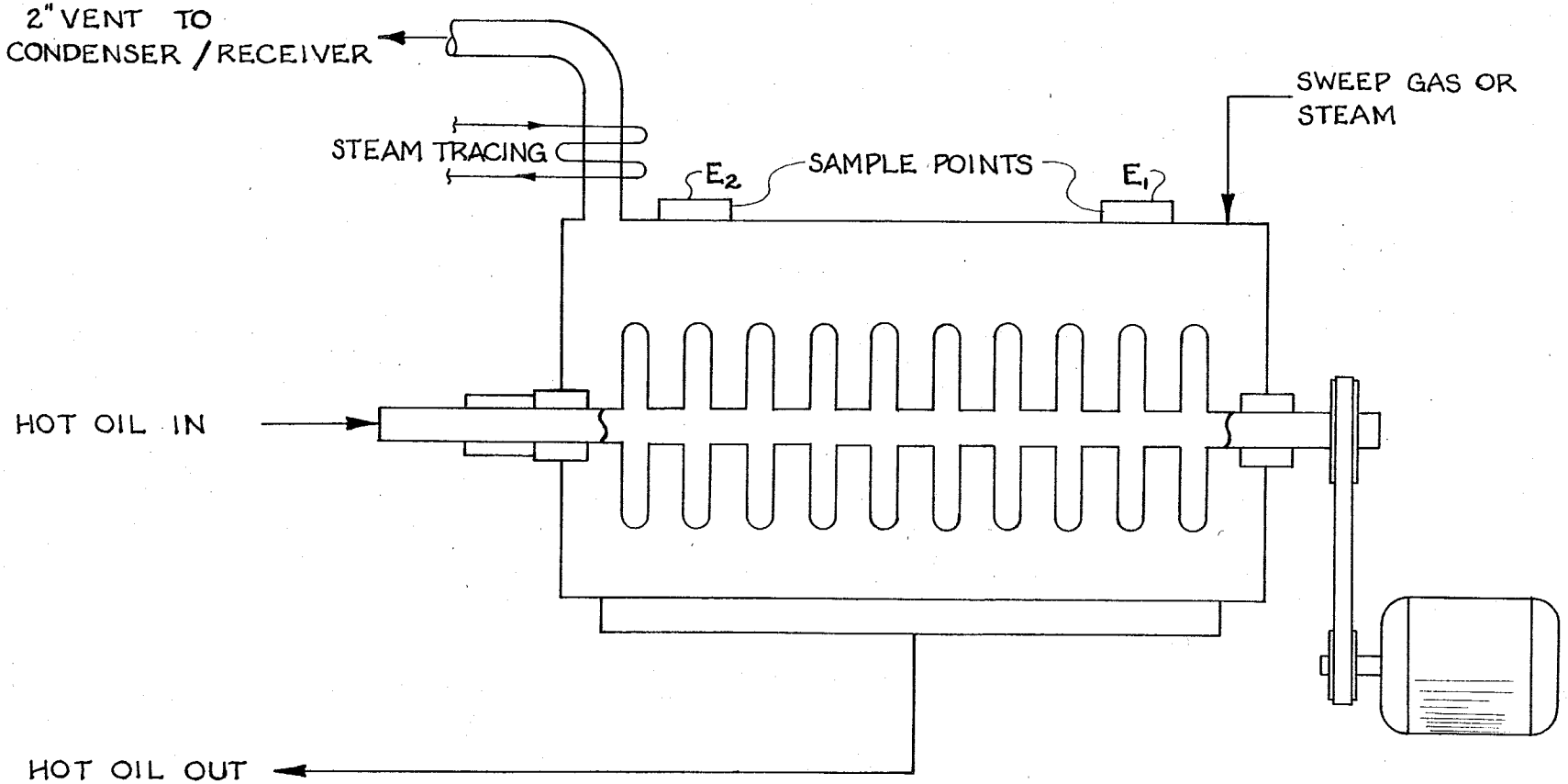
FIG. 2 is a diagram of a TorusDisc drier used in the Examples, identifying the sample ports.

The drawing represents a preferred embodiment of the present invention as applied to a process for recovery of bitumen from tar sands.

With particular reference to the drawings a tar sand which maybe water wet is contacted with an extraction solvent, or the substantially dry sand contacted with a an extraction solvent, e.g. a chlorinated hydrocarbon, is collected from the solids outlet of a rinser or extractor/-rinser and forwarded solvent wet to a "drier" in which heat is applied to to drive off the residual extractant from the raffinate (extracted sand). In accordance with the present invention it has been found advantageous to add water to the solvent-wet sand prior to entering the drier. The extractant with some small percentage of water of course goes overhead from the drier, and being immiscible with the extractant at room temperature is readily separated after condensation from the extractant. The sand (raffinate) still wet with water and to which the sand fines are agglomerated is essentially free flowing and the water will gradually evaporate therefrom on exposure of the sand and fines (raffinate) to the atmosphere.

The point of addition of the water does not appear to be critical, thus water can be added to the sand prior to extraction, point A of the drawing; during extraction, point B; with the clean solvent to the rinser point C; to the extracted sand-solvent going to the drier point D. Further, steam capable of condensing during passage through the drier or water may be added at Point E to the drier or at one or more points along the drier.

The amount of water employed is insufficient to slurry the raffinate and it is usually sufficient to employ from 1 to 20 weight percent water and preferably from 2 to 10 percent water. Exceptionally good results have been experienced with 2–6 percent water.

In a series of experiments to demonstrate the effectiveness of the process of the present invention, tar sand which had been extracted with methylene chloride to dissolve the bitumen was indirectly heated in a hollow disc drier (TorusDisc) using 170° F. oil for 1 hour during which period frequent samples were taken through two ports in the drier, one near each end designated E1 and E2. Thereafter, water or steam was added to establish the most effective manner of adding the water. The results of such tests are detailed in the following tables:

| Run Time (min) | Bed Temp. (°F.) | $MeCl_2$ Residual[1] (%) | Water Content of sand (%) | Evidence of fines in sample port (cloud of smoke)[2] |
|---|---|---|---|---|
| | | A (comparison) | | |
| 0 | RT[3] | 26% | 0.200[6] | — |
| 5 | 97 | 16.96[4] | — | yes |
| 10 | 97 | 10.00 | — | yes |
| 20 | 124 | 0.10 | — | yes |
| 30 | 160 | 0.0203 | — | yes* |
| 40 | 168 | 0.0140 | 0.058 | yes* |
| 50 | 171 | 0.0124 | — | yes* |
| 60 | 173 | 0.0097 | 0.047 | yes* |

-continued

| Run Time (min) | Bed Temp. (°F.) | $MeCl_2$ Residual[1] (%) | Water Content of sand (%) | Evidence of fines in sample port (cloud of smoke)[2] |
|---|---|---|---|---|
| 1. Steam Sparge started at ten minutes to port E-1 | | | | |
| | E1/E2 | E1/E2 | E1/E2 | E1/E2 |
| 0 | RT | 26% | 0.200 | — |
| 10 | 98/98 | 7.33/8.31[4] | 0.159/0.1-74 | Yes/Yes |
| 15 | 100/101 | 0.377/0.673 | 0.276/0.1-10 | Yes/Yes |
| 25 | 166/150 | 0.0039/0.0099 | 0.998/0.1-46 | Yes/Yes |
| 36 | 179/169 | 0.0009/0.0011[5] | 3.45/0.1-50 | No/Yes |
| 48 | 177/174 | 0.0002/0.001 | 2.79/0.6-58 | No/Yes |
| 54 | 177/174 | 0.0001/0.001 | 4.90/0.1-57 | No/Yes |
| 2. added 6% water at start; no sparge gas | | | | |
| 0 | RT | 26% | 0.200 | — |
| 10 | 96/94 | 10.62/10.23[5] | 5.50/5.50 | No/No |
| 20 | 141/138 | 0.0277/0.0310 | — | No/No |
| 32 | 164/162 | 0.0058/0.0015 | — | No/No |
| 40 | 167/166 | 0.0030/0.0010 | 5.40/5.91 | No/No |
| 50 | 168/167 | 0.0014/0.0004 | 4.47/5.26 | No/No |
| 60 | — | 0.0006/0.0002 | 4.00/4.00 | No/No |

*excessive fines produced as sand becomes drier

[1]residual $MeCl_2$ on sand was analyzed by placing a sand sample in perchloroethylene to dissolve the residual $MeCl_2$. followed by GC analysis for $MeCl_2$.

[2]When drier ports are opened, smoke (fines in the vapor) issues forth. This condition gets worse as material gets drier and hotter. With ~2% $H_2O$ on sand, no smoke at any temperature with or without sparge gas.

[3]RT = room temperature

[4]Many fines were present in the perchloroethylene used for $MeCl_2$ analysis in the dusty samples which showed smoke in the drier.

[5]Sand with ~2% $H_2O$ produced no fines in Perchloroethylene in performing $MeCl_2$ analysis.

[6]No added water to sand.

Note that when steam was used as sweep gas, some steam condensed wetting the sand near the steam sweep entrance and reduced the fines at this port.

Note also that when water is added to the sand/solvent no sweep gas is required.

We claim:

1. In a process for maintaining fines of a mass of larger attritable solid particles in association with said mass of larger particles while removing a residual solvent therefrom by contacting the mass of solid particles with a heat source the improvement which comprises adding to the mass from about 1 to about 20 weight percent water based on the weight of the mass, solvent and the water to agglomerate on and with the larger particles the fines and thereby maintain the fines with said larger solid particles.

2. In the process of claim 1 wherein the mass of solid particles is sand and the residual solvent is a chlorinated hydrocarbon solvent.

3. In the process of claim 1 wherein the amount of added water is 2 to 10 percent.

4. In the process of claim 1 wherein the amount of added water is 2 to 6 percent.

5. In the process of claim 1 wherein the water is added to the sand prior to contact with the solvent.

6. In the process of claim 1 wherein the water is added with the solvent to the sand.

7. In the process of claim 1 wherein the water is added to the sand after the bulk of the solvent has been separated from the mass.

8. In the process of claim 2 wherein the water is added prior to removal in a drier of residual solvent remaining with the sand.

9. In the process of claim 2 wherein the residual solvent is methylene chloride.

* * * * *